US012540048B2

(12) United States Patent
Ito

(10) Patent No.: US 12,540,048 B2
(45) Date of Patent: Feb. 3, 2026

(54) MEDIUM CONVEYING APPARATUS TO DETECT PREDETERMINED MEDIUM BASED ON LIFT OF MEDIUM

(71) Applicant: PFU LIMITED, Kahoku (JP)

(72) Inventor: Takumi Ito, Kahoku (JP)

(73) Assignee: PFU LIMITED, Kahoku (JP)

( * ) Notice: Subject to any disclaimer, the term of this patent is extended or adjusted under 35 U.S.C. 154(b) by 215 days.

(21) Appl. No.: 18/339,975

(22) Filed: Jun. 22, 2023

(65) Prior Publication Data

US 2024/0025681 A1 Jan. 25, 2024

(30) Foreign Application Priority Data

Jul. 20, 2022 (JP) ..... 2022-115791

(51) Int. Cl.
*B65H 7/06* (2006.01)
*B65H 3/06* (2006.01)
*B65H 7/14* (2006.01)

(52) U.S. Cl.
CPC ..... *B65H 7/06* (2013.01); *B65H 3/06* (2013.01); *B65H 7/14* (2013.01); *B65H 2513/10* (2013.01); *B65H 2601/26* (2013.01)

(58) Field of Classification Search
CPC ..... B65H 7/06; B65H 2701/18292; B65H 2701/1829
See application file for complete search history.

(56) References Cited

U.S. PATENT DOCUMENTS 8,837,017 B2 * 9/2014 Murakami ..... H04N 1/0071 358/488
10,584,007 B2 * 3/2020 Matsumura ..... B65H 5/062
12,122,634 B2 * 10/2024 Eguchi ..... H04N 1/00737

FOREIGN PATENT DOCUMENTS

JP 6608603 B2 * 11/2019
JP 2021-24711 A 2/2021

OTHER PUBLICATIONS

Translation of JP-6608603-B2 (Year: 2025).*

* cited by examiner

*Primary Examiner* — Howard J Sanders
(74) *Attorney, Agent, or Firm* — Womble Bond Dickinson (US) LLP

(57) ABSTRACT

A medium conveying apparatus includes a pick roller, a first lift sensor located on one side of the pick roller, a second lift sensor located on another side of the pick roller, a first detection sensor located on a same side as the first lift sensor, a second detection sensor located on a same side as the second lift sensor, and a processor to determine whether the medium is a predetermined medium, based on a detection result of a lift of the medium by the first or second lift sensor and to execute abnormality control when the medium is determined to be the predetermined medium, wherein the processor makes it difficult for the medium to be determined as a predetermined medium when it is detected that the first detection sensor side of the medium precedes the second detection sensor side.

12 Claims, 14 Drawing Sheets

MEDIUM CONVEYING APPARATUS TO DETECT PREDETERMINED MEDIUM BASED ON LIFT OF MEDIUM

CROSS-REFERENCE TO RELATED APPLICATION

This application is based upon and claims the benefit of priority of prior Japanese Patent Application NO. 2022-115791, filed on Jul. 20, 2022, the entire contents of which are incorporated herein by reference.

FIELD

The present invention relates to a medium conveying apparatus to detect a predetermined medium based on a lift of a medium.

BACKGROUND

In general, a medium conveying apparatus, such as a scanner, conveying and imaging a medium sequentially separates and conveys a plurality of stacked media placed on a loading tray. However, when a plurality of media are bound by a staple or the like, the media may be damaged when the media are separated. Therefore, it is required of the medium conveying apparatus to execute abnormality control such as suitably detecting such bound medium and stopping conveyance.

PTL 1 (Japanese Unexamined Patent Publication (Kokai) No. 2021-24711) describes an image reading device including first to third sheet detection means being located on a conveyance path of a medium and detecting the medium, and determining whether the medium is a bound medium, based on the time difference between times at which the sheet detection means detect the medium, respectively. Since a bound medium moves obliquely when being separated, whether a medium is a bound medium can be determined, based on the difference between detection times caused by oblique movement of the medium.

SUMMARY

According to an aspect of the apparatus, provided is a medium conveying apparatus including a pick roller to feed a medium, a first lift sensor located on a downstream side of an upstream edge of a nip width of the pick roller and on one side of the pick roller toward a conveying direction of the medium, to detect a lift of the medium, a second lift sensor located on a downstream side of an upstream edge of the nip width of the pick roller and on another side of the pick roller toward the conveying direction, to detect a lift of the medium, a first detection sensor located on a same side as the first lift sensor with respect to the pick roller, to detect the medium, a second detection sensor located on a same side as the second lift sensor with respect to the pick roller, to detect a medium, and a processor to determine whether the medium is a predetermined medium, based on a detection result of a lift of the medium by the first or second lift sensor and execute abnormality control when the medium is determined to be the predetermined medium, wherein the processor makes it difficult for the medium to be determined as the predetermined medium based on the detection result of a lift of the medium by the first lift sensor when it is detected by the first and second detection sensors that the first detection sensor side of the medium precedes the second detection sensor side.

According to an aspect of the method, provided is a medium conveying method including feeding a medium by a pick roller, detecting a lift of the medium by a first lift sensor located on a downstream side of an upstream edge of a nip width of the pick roller and on one side of the pick roller toward a conveying direction of the medium, detecting a lift of the medium by a second lift sensor located on a downstream side of an upstream edge of the nip width of the pick roller and on another side of the pick roller toward the conveying direction, detecting the medium by a first detection sensor located on a same side as the first lift sensor with respect to the pick roller, detecting the medium by a second detection sensor located on a same side as the second lift sensor with respect to the pick roller, determining whether the medium is a predetermined medium, based on a detection result of a lift of the medium by the first or second lift sensor; and executing abnormality control when the medium is determined to be the predetermined medium, wherein, in the determination, it is made difficult for the medium to be determined as the predetermined medium based on a detection result of a lift of a medium by the first lift sensor when the first detection sensor side of the medium is detected to precede the second detection sensor side by the first and second detection sensors.

According to an aspect of the computer-readable, non-transitory medium, provided is a computer-readable, non-transitory storage medium storing a computer program for a medium conveying apparatus including a pick roller feeding a medium, a first lift sensor located on a downstream side of an upstream edge of a nip width of the pick roller and on one side of the pick roller toward a conveying direction of the medium, to detect a lift of the medium, a second lift sensor located on a downstream side of an upstream edge of the nip width of the pick roller and on another side of the pick roller toward the conveying direction, to detect a lift of the medium, a first detection sensor located on a same side as the first lift sensor with respect to the pick roller, to detect the medium, and a second detection sensor located on a same side as the second lift sensor with respect to the pick roller, to detect the medium, the computer program causing the medium conveying apparatus to execute a process, the process including determining whether the medium is a predetermined medium, based on a detection result of a lift of the medium by the first or second lift sensor, and executing abnormality control when the medium is determined to be the predetermined medium, wherein, in the determination, it is made difficult for the medium to be determined as the predetermined medium based on the detection result of a lift of a medium by the first lift sensor when the first detection sensor side of the medium is detected to precede the second detection sensor side by the first and second detection sensors.

DESCRIPTION OF EMBODIMENTS

It is to be understood that both the foregoing general description and the following detailed description are exemplary and explanatory, and are not restrictive of the invention as claimed.

Figure 1:
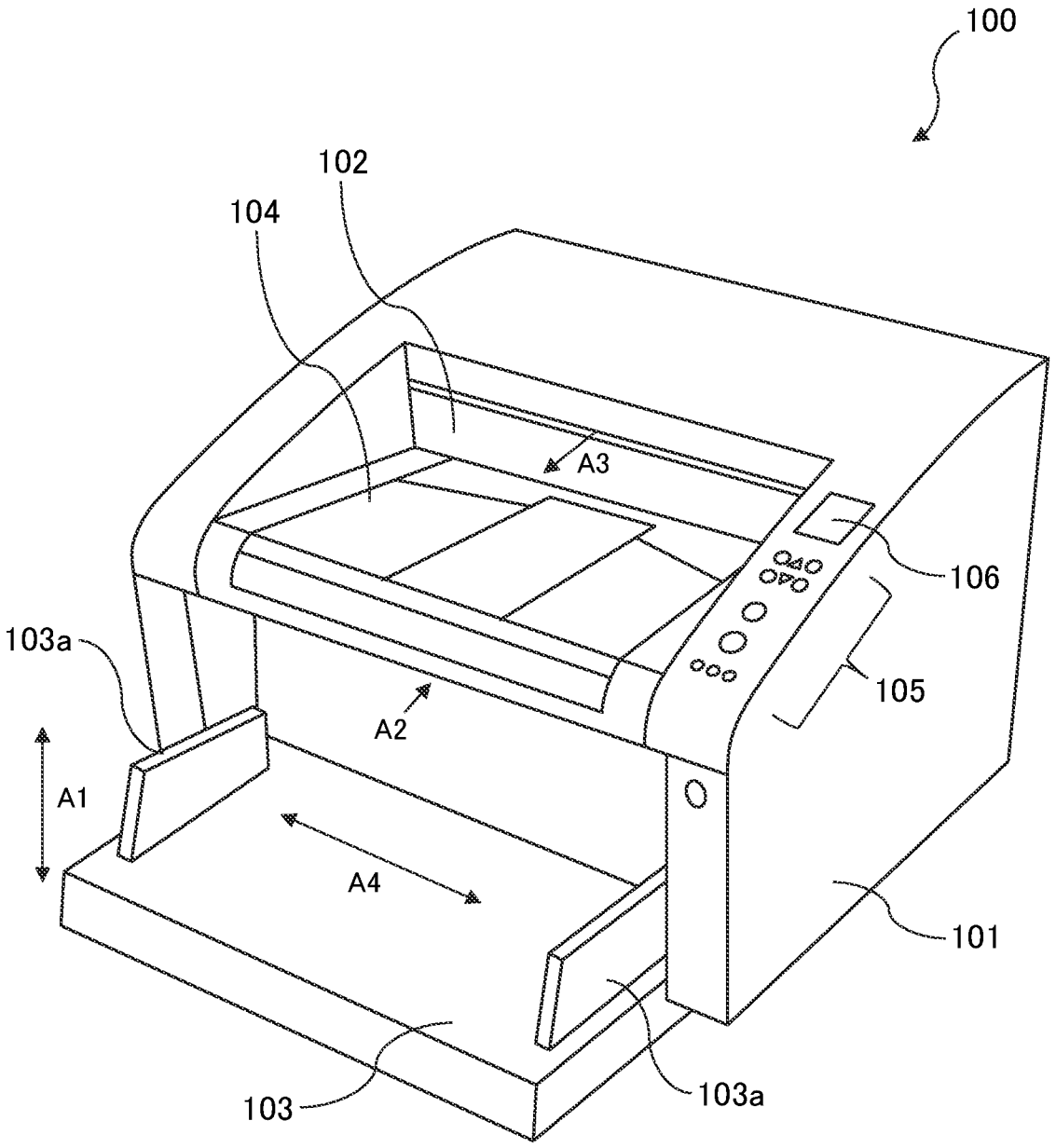
FIG. 1 is a perspective view of a medium conveying apparatus 100.

FIG. 1 is a perspective view illustrating a medium conveying apparatus 100 according to an embodiment. The medium conveying apparatus 100 is an image scanner. The medium conveying apparatus 100 conveys and images a medium being an original. A medium is a paper, a thick paper, a card, or the like. The medium conveying apparatus 100 may also be a facsimile, a copying machine, a multifunctional peripheral (MFP), or the like. The medium conveying apparatus 100 may also be a printer conveying a medium being an object being printed on.

In FIG. 1, an arrow A1 indicates an almost vertical direction (height direction), an arrow A2 indicates a conveying direction of a medium, an arrow A3 indicates an ejecting direction of a medium, and an arrow A4 indicates a width direction orthogonal to the conveying direction A2 or the ejecting direction A3. An upstream side hereinafter refers to an upstream side in the conveying direction A2 or the ejecting direction A3, and a downstream side refers to a downstream side in the conveying direction A2 or the ejecting direction A3.

The medium conveying apparatus 100 includes a first housing 101, a second housing 102, a loading tray 103, an output tray 104, an operation device 105, and a display device 106.

The first housing 101 and the second housing 102 are examples of a housing. The second housing 102 is located inside the first housing 101 and is rotatably engaged with the first housing 101 by a hinge in such a way as to be openable when a jam occurs or cleaning of the inside of the medium conveying apparatus 100 is performed.

The loading tray 103 is engaged with the first housing 101 in such a way as to be able to place a medium to be conveyed. The loading tray 103 is provided on the side of the first housing 101. The loading tray 103 is movable in the height direction A1. The loading tray 103 is positioned at the lower end of the first housing in such a way that a medium can be easily located when a medium is not conveyed. The loading tray 103 is raised to a position where a medium located on the uppermost side comes in contact with a pick roller to be described later when a medium is conveyed.

A pair of side guides 103*a* regulating a width direction of a medium are located at both ends of the top surface of the loading tray 103 in the width direction A4. The side guides 103*a* protrude upward with respect to the top surface of the loading tray 103 and extend in the conveying direction A2. A medium is placed between the pair of side guides 103*a*.

The output tray 104 is formed on the top surface of the second housing 102. The output tray 104 includes a placement surface for placing a medium ejected from an outlet of the first housing 101 and the second housing 102.

The operation device 105 includes an input device such as a button, and an interface circuit acquiring a signal from the input device. The operation device 105 accepts an input operation by a user and outputs an operation signal based on the input operation by the user. The display device 106 includes a display including a liquid crystal display, an organic electro-luminescence (EL) display, or the like and an interface circuit outputting image data to the display. The display device 106 displays the image data on the display. The display device 106 may be a liquid crystal display with a touch panel function. In this case, the operation device 105 includes an interface circuit acquiring an input signal from the touch panel.

Figure 2:
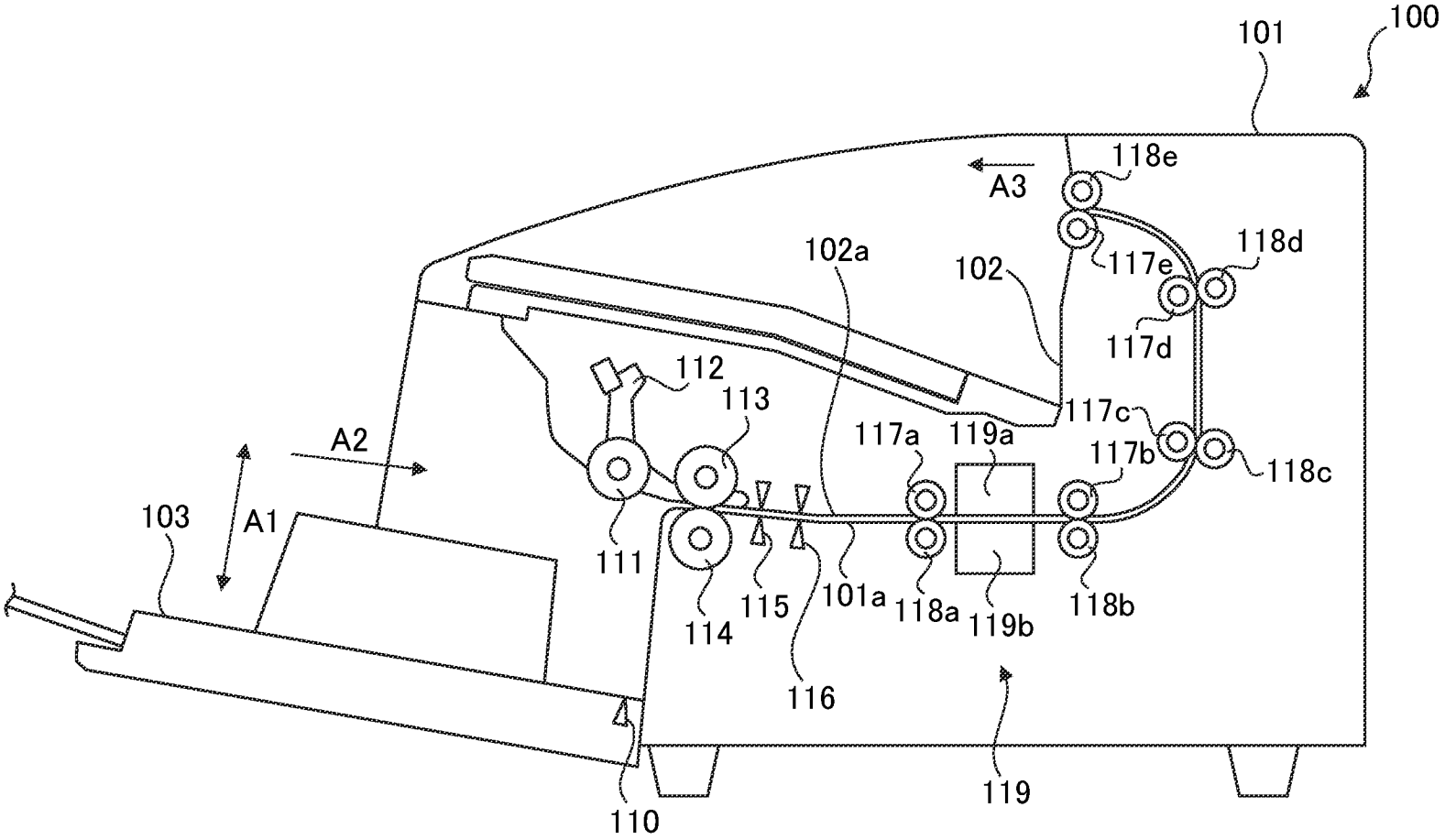
FIG. 2 is a diagram illustrating a conveyance path inside the medium conveying apparatus 100.

FIG. 2 is a diagram illustrating a conveyance path inside the medium conveying apparatus 100.

The conveyance path inside the medium conveying apparatus 100 includes a first medium sensor 110, a passing sensor 111, a pick roller 112, a lift sensor 113, a feed roller 114, a separation roller 115, a second medium sensor 116, first to fifth conveyance rollers 117*a* to *e*, first to fifth driven rollers 118*a* to *e*, and an imaging device 119.

The number of the pick roller 112, the feed roller 114, the separation roller 115, the first to fifth conveyance rollers 117*a* to *e*, and/or the first to fifth driven rollers 118*a* to *e* is not limited to one and may be more than one. In that case, the plurality of pick rollers 112, the feed rollers 114, the separation roller 115, the first to fifth conveyance rollers 117*a* to *e*, and/or the first to fifth driven rollers 118*a* to *e* are respectively spaced in the width direction A4.

A surface of the first housing 101 facing the second housing 102 forms a first guide 101*a* of a conveyance path of a medium, and a surface of the second housing 102 facing the first housing 101 forms a second guide 102*a* of the conveyance path.

The first medium sensor 110 is located on the loading tray 103 on the upstream side of the feed roller 114 and the separation roller 115. The first medium sensor 110 detects whether a medium is located on the loading tray 103. The first medium sensor 110 detects whether a medium is located on the loading tray 103 by a contact detection sensor passing predetermined current when being in contact with a medium or when not being in contact with a medium. The first medium sensor 110 generates and outputs a first medium signal with a signal value varying by whether a medium is located on the loading tray 103. The first medium sensor 110 may be any other sensor, such as a light detection sensor, that can detect whether a medium is located on the loading tray 103.

The pick roller 111 is located in the second housing 102. The pick roller 111 comes in contact with a medium placed on the loading tray 103 raised to a height almost identical to that of the conveyance path of a medium and feeds the medium toward the downstream side.

The lift sensor 112 is located inside the second housing 102 and on the downstream side of the pick roller 111. The lift sensor 112 detects a lift of a medium fed by the pick roller 111. A lift of a medium refers to a fed medium being curved toward the second housing 102 side with respect to the conveyance path. The lift sensor 112 detects a lift of a medium by generating and outputting a lift signal with a signal value varying by whether the medium lifts. A structure of the lift sensor 112 will be described later by use of FIG. 3

The feed roller 113 is located inside the second housing 102 and on the downstream side of the pick roller 111. The feed roller 113 feeds a medium fed by the pick roller 111 further toward the downstream side. The separation roller 114 is located inside the first housing 101 in such a way as to face the feed roller 113. The separation roller 114 is a so-called brake roller or a retard roller and can rotate in a direction opposite to the medium feeding direction or can stop. The feed roller 113 and the separation roller 114 separate media and feed one medium at a time. The feed roller 113 is located above the separation roller 114, and the medium conveying apparatus 100 feeds media by a so-called top-first scheme. The feed roller 113 may be located below the separation roller 114, and the medium conveying apparatus 100 may feed media by a so-called bottom-first type.

The second medium sensor 115 is located on the downstream side of the feed roller 113 and the separation roller 114. The second medium sensor 115 detects a medium. The second medium sensor 115 is a recurrent prism sensor. The second medium sensor 115 includes a light-emitting element, such as a light emitting diode (LED), and a light-receiving element, such as a photodiode, located inside the first housing 101, and a light-guiding member, such as a prism, located inside the second housing 102. The light-guiding member is placed in such a way as to face the light-emitting element and the light-receiving element with the conveyance path of a medium in between and guide light projected from the light-emitting element to the light-receiving element. The second medium sensor 115 generates and outputs, as a second medium signal, a signal with a signal value being based on the intensity of light detected by the light-receiving element, i.e., a signal value varying by whether light projected from the light-emitting element is blocked by a medium. For example, when the second medium signal indicates that the light projected from the light-emitting element is blocked by a medium, the second medium sensor 115 detects the medium. The second medium sensor 115 may be any other sensor, such as a contact detection sensor, that can detect a medium.

The tilt sensor 116 is placed on the downstream side of the feed roller 113 and the separation roller 114. The tilt sensor 116 detects a tilt of a medium. The tilt sensor 116 includes a first detection sensor 116-1 and a second detection sensor 116-2 being spaced in the width direction A4, each sensor detecting a medium at the position where the sensor is placed.

The first detection sensor 116-1 is a recurrent prism sensor similar to the second medium sensor 115 and includes a light-emitting element, such as an LED, and a light-receiving element, such as a photodiode, placed inside the first housing 101, and a light-guiding member, such as a prism, placed inside the second housing 102. The first detection sensor 116-1 generates and outputs, as a first detection signal with a signal value being based on the intensity of light detected by the light-receiving element, i.e., a signal value varying by whether light projected from the light-emitting element is blocked by a medium. For example, the first detection sensor 116-1 detects the front edge of a medium when the first detection signal changes from a state indicating that the light projected from the light-emitting element is not blocked by the medium to a state indicating that the light is blocked by the medium.

The second detection sensor 116-2 is also a recurrent prism sensor similar to the second medium sensor 115 and includes a light-emitting element, such as an LED, and a light-receiving element, such as a photodiode, placed inside the first housing 101, and a light-guiding member, such as a prism, placed inside the second housing 102. The second detection sensor 116-2 generates and outputs, as a second detection signal, a signal with a signal value being based on the intensity of light detected by the light-receiving element, i.e., a signal value varying by whether light projected from the light-emitting element is blocked by a medium. For example, the second detection sensor 116-2 detects the front edge of a medium when the second detection signal changes from a state indicating that the light projected from the light-emitting element is not blocked by the medium to a state indicating that the light is blocked by the medium.

The tilt sensor 116 detects a tilt of a medium when the time difference between the time at which the first detection sensor 116-1 detects the front edge of the medium and the time at which the second detection sensor 116-2 detects the front edge of the medium is greater than or equal to a threshold value.

The first to fifth conveyance rollers 117*a* to *e* and the first to fifth driven rollers 118*a* to *e* are provided on the downstream side of the feed roller 113 and the separation roller 114 in such a way as to face each other, respectively. The first to fourth conveyance rollers 117*a* to *d* and the first to fourth driven rollers 118*a* to *d* convey a medium fed by the feed roller 113 and the separation roller 114 toward the downstream side. The fifth conveyance roller 117*e* and the fifth driven roller 118*e* eject the medium conveyed by the first to fourth conveyance rollers 117*a* to *d* and the first to fourth driven rollers 118*a* to *d* onto the output tray 104.

The imaging device 119 is located on the downstream side of the first conveyance roller 117*a* in the conveying direction A2 and images a medium conveyed by the first conveyance roller 117*a* and the first driven roller 118*a*. The imaging device 119 includes a first imaging device 119*a* and a second imaging device 119*b* that are located in such a way as to face each other with the conveyance path of a medium in between. The first imaging device 119*a* and the second imaging device 119*b* are examples of an imaging unit.

The first imaging device 119*a* includes a line sensor based on a unity-magnification optical system type contact image sensor (CIS) including complementary metal oxide semiconductor-(CMOS-) based imaging elements linearly arranged in a main scanning direction. The first imaging device 119*a* further includes lenses each forming an image on the imaging elements, and an A/D converter amplifying and analog-digital (A/D) converting an electric signal output from the imaging elements. The first imaging device 119*a* generates an input image by imaging the front side of a conveyed medium and outputs the generated image.

Similarly, the second imaging device 119*b* includes a line sensor based on a unity-magnification optical system type CIS including CMOS-based imaging elements linearly arranged in the main scanning direction. The second imaging device 119*b* further includes lenses each forming an image on the imaging elements, and an A/D converter amplifying and A/D converting an electric signal output from the imaging elements. The second imaging device 119*b* generates an input image by imaging the back side of a conveyed medium and outputs the generated image.

The imaging device 119 may include only one of the first imaging device 119*a* and the second imaging device 119*b* and read only one side of a medium. Each of the first imaging device 119*a* and the second imaging device 119*b* may include a line sensor based on a unity-magnification optical system type CIS including charge coupled device—(CCD-) based imaging elements in locate of the line sensor based on a unity-magnification optical system type CIS including CMOS-based imaging elements. Each of the first imaging device 119*a* and the second imaging device 119*b* may include a reduction optical system type line sensor including CMOS-based or CCD-based imaging elements.

A medium placed between the pair of side guides 103*a* on the loading tray 103 is conveyed between the first guide 101*a* and the second guide 102*a* along the conveying direction A2 by rotation of each of the pick roller 111 and the feed roller 113 in the feeding direction of the medium. As a feed mode of the medium conveying apparatus 100, a user may set either a separation mode of feeding a medium while separating the medium or a non-separation mode of feeding a medium without separation. The feed mode is set by operating, by the user, an information processing device connected to the operation device 105 or the medium conveying apparatus 100 by communication. When the feed mode is set to the separation mode, the separation roller 114 rotates in a direction opposite to the feeding direction of a medium or stops. Consequently, feed of a medium other than the separated medium is restricted, and multi feed is prevented. On the other hand, when the feed mode is set to the non-separation mode, the separation roller 114 rotates in the feeding direction of a medium.

A medium is conveyed between the first guide 101*a* and the second guide 102*a* by rotation of the first conveyance roller 117*a* in the feeding direction of the medium. The medium is then fed to an imaging position of the imaging device 119, and imaged by the imaging device 119. The medium is further ejected onto the output tray 104 by rotation of each of the second to fifth conveyance rollers 117*b* to *e* in the feeding direction of the medium.

Figure 3:
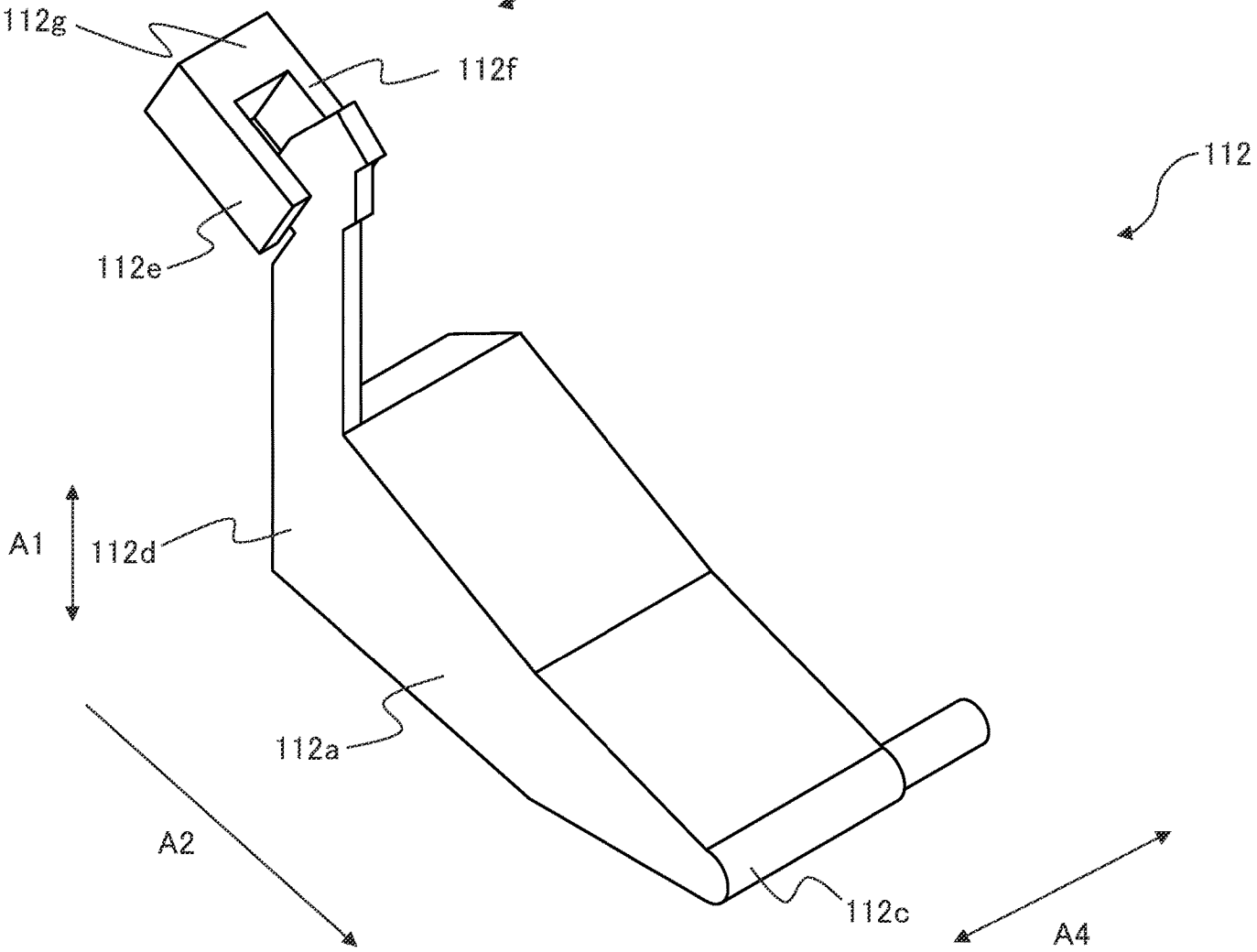
FIG. 3 is a perspective view of a lift sensor 112.

FIG. 3 is a perspective view of the lift sensor 112. The lift sensor 112 includes an arm 112*a* and a horseshoe-shaped sensor 112*b*.

The arm 112*a* is provided above the conveyance path of a medium in such a way as to extend in the conveying direction A2 and is located in such a way that the bottom surface of the arm 112*a* faces the first guide 101*a* separated by a predetermined distance. A plurality of lift sensors 112 may be spaced in the width direction A4. In this case, the arm 112*a* are located at an identical height with respect to the first guide 101*a*. A downstream-side edge 112*c* of the arm 112*a* is rotatably engaged with the second housing 102 in such a way that an upstream-side edge 112*d* swings. Consequently, when a medium lifts, the medium comes in contact with the arm 112*a* and raises the arm 112*a* by rotating the arm 112*a*. The distance between the bottom surface of the arm 112*a* and the first guide 101*a* when a lift on a medium does not exist is appropriately set according to the magnitude of bending of a medium required to be detected by the lift sensor 112.

The horseshoe-shaped sensor 112*b* includes a light-emitting element 112*e*, a light-receiving element 112*f*, and a connecting part 112*g* connecting the light-emitting element 112*e* to the light-receiving element 112*f*. The light-emitting element 112*e* and the light-receiving element 112*f* are located in such a way as to face each other. The light-emitting element 112*e* is an LED or the like and projects light toward the light-receiving element 112*f*. The light-receiving element 112*f* is a photodiode or the like. The light-emitting element 112*e* and the light-receiving element 112*f* are examples of a light emitting unit and a light receiving unit, respectively. The light-receiving element 112*f* is provided in such a way as to face the light-emitting element 112*e* with the arm 112*a* in between and detects light from the light-emitting element 112*e*. The light-receiving element 112*f* generates and outputs a lift detection signal being an electric signal based on the intensity of detected light. The horseshoe-shaped sensor 112*b* is an example of a detector.

The arm 112*a* is provided in such a way as to be located between the light-emitting element 112*e* and the light-receiving element 112*f* in an initial state and be located at a position not facing the light-emitting element 112*e* and the light-receiving element 112*f* in a raised state. In other words, the arm 112*a* is formed in such a way as to interrupt light from the light-emitting element 112*e* to the light-receiving element 112*f* in an unraised state and pass the light from the light-emitting element 112*e* to the light-receiving element 112*f* in the raised state. The horseshoe-shaped sensor 112*b* generates, as a lift signal, a signal with a signal value being based on the intensity of light detected by the light-receiving element 112*f*, i.e., a signal value varying by whether a fed medium lifts. For example, the lift sensor 112 detects a lift of a medium when the intensity of light detected by the light-receiving element 112*f*, the intensity being indicated by the lift signal, is greater than or equal to a threshold value.

Figure 4:
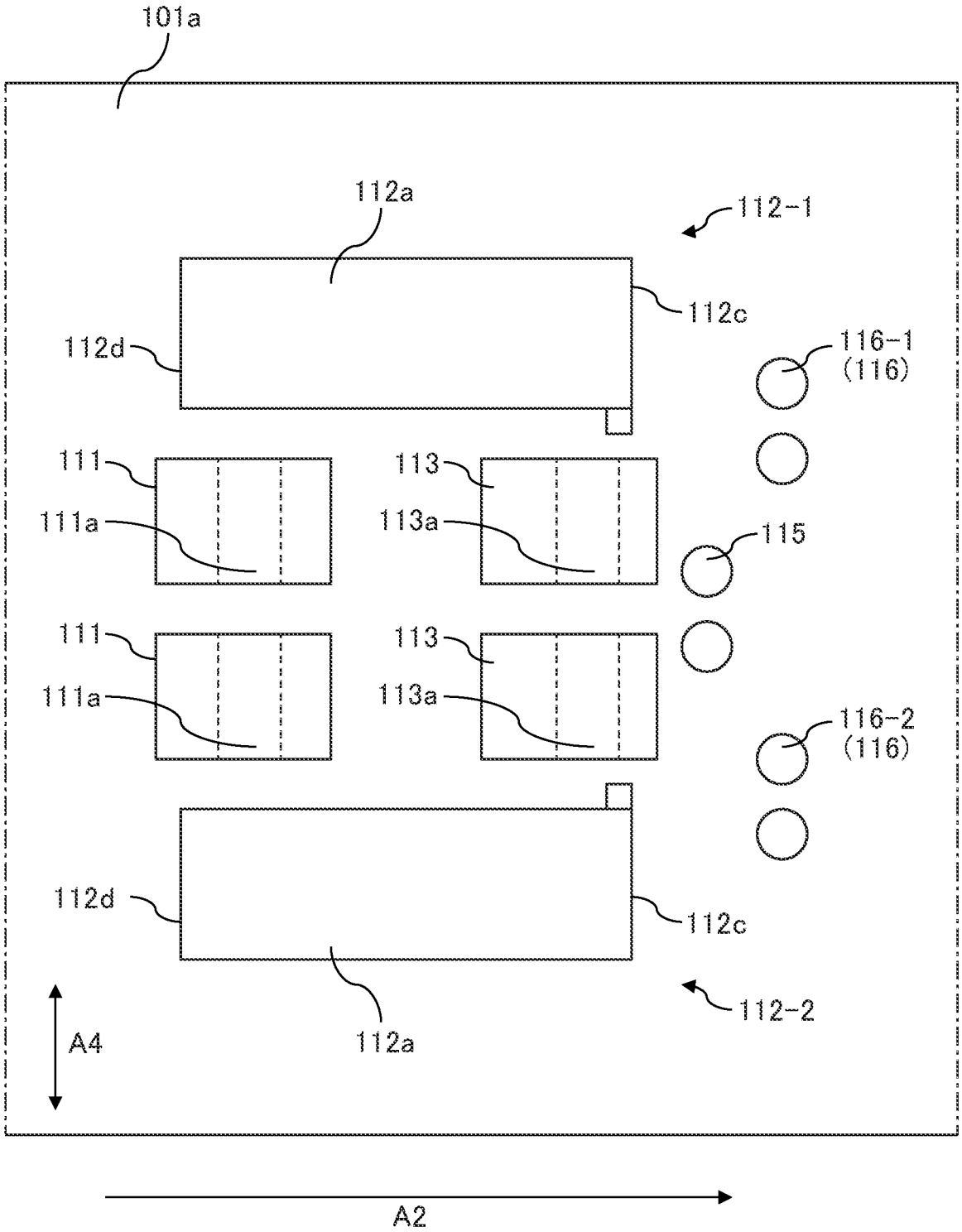
FIG. 4 is a diagram schematically illustrating placement of the lift sensors 112, a second medium sensor 115, and tilt sensors 116.

FIG. 4 is a diagram schematically illustrating placement of the lift sensors 112, the second medium sensor 115, and the tilt sensors 116. FIG. 4 is a diagram of the conveyance path viewed from the top.

The lift sensor 112 includes a first lift sensor 112-1 and a second lift sensor 112-2. The first lift sensor 112-1 is located on the left side of the pick roller 111 and the feed roller 113 toward the conveying direction A2, i.e., in the width direction A4. The second lift sensor 112-2 is located on the right side of the pick roller 111 and the feed roller 113 toward the conveying direction A2, i.e., in the width direction A4. Structures of the first lift sensor 112-1 and the second lift sensor 112-2 are the same except that the structures are symmetric with respect to the width direction A4.

The first lift sensor 112-1 and the second lift sensor 112-2 are located in such a way as to be separated from the pick roller 111 and the feed roller 113 by a predetermined distance in the width direction A4. The predetermined distance is set in such a way that when a medium with the shortest length in the width direction A4 (such as an A5 size) out of media likely to be bound by a staple, a clip, or the like is conveyed at the center in the width direction A4, an edge of the medium in the width direction A4 passes below the arm 112*a*. Consequently, when a bound medium bound by a staple, a clip, or the like is conveyed, the lift sensor 112 can reliably detect a lift of the medium.

The upstream edge 112*d* of the arm 112*a* of each of the first lift sensor 112-1 and the second lift sensor 112-2 is positioned on the upstream side of the upstream edge of a nip width 111*a* of the pick roller 111. The downstream edge 112*c* of the arm 112*a* of each of the first lift sensor 112-1 and the second lift sensor 112-2 is positioned on the downstream side of the downstream edge of a nip width 113*a* of the feed roller 113 and the separation roller 114. Consequently, the lift sensor 112 detects a lift of a medium between the upstream edge of the nip width 111*a* of the pick roller 111 and the downstream edge of the nip width 113*a* of the feed roller 113 and the separation roller 114.

The second medium sensor 115 is located on the downstream side of the feed roller 113 and the separation roller 114. The second medium sensor 115 is located between the two feed rollers 113 and, for example, is located at the center in the width direction A4. A plurality of second medium sensors 115 may be spaced along the width direction A4.

The first detection sensor 116-1 and the second detection sensor 116-2 in the tilt sensor 116 are located on the downstream side of the second medium sensor 115 and are spaced from each other in the width direction A4. The first detection sensor 116-1 is located on the left side of the pick roller 111 and the feed roller 113 toward the conveying direction A2, i.e., in the width direction A4. The second detection sensor 116-2 is located on the right side of the pick roller 111 and the feed roller 113 toward the conveying direction A2, i.e., in the in the width direction A4. In other words, the first detection sensor 116-1 is located on the same side as the first lift sensor 112-1 with respect to the pick roller 111, and the second detection sensor 116-2 is located on the same side as the second lift sensor 112-2 with respect to the pick roller 111.

Figure 5:
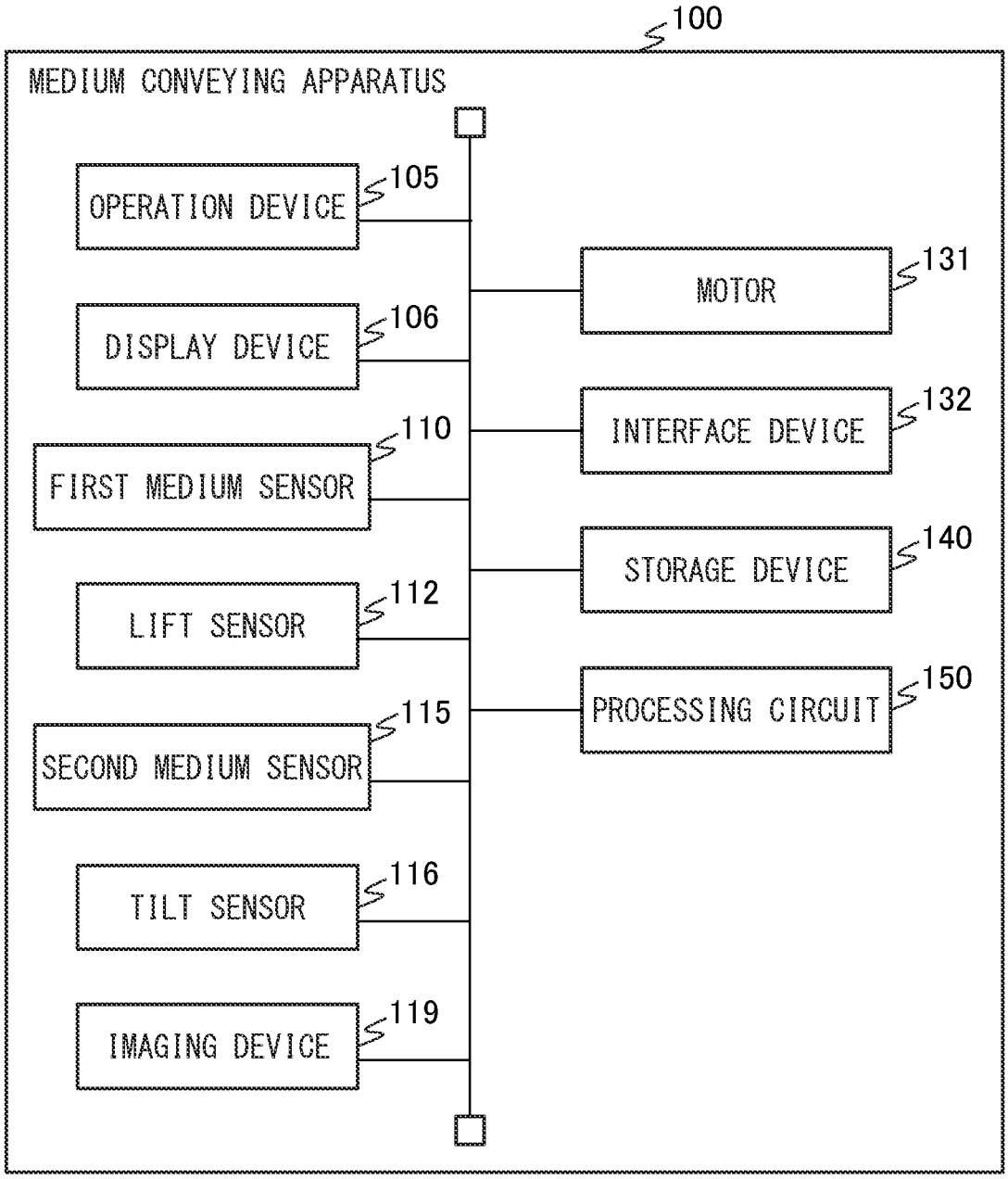
FIG. 5 is a functional block diagram of the medium conveying apparatus 100.

FIG. 5 is a block diagram illustrating an example of a schematic configuration of the medium conveying apparatus 100. In addition to the configuration described above, the medium conveying apparatus 100 further includes a motor 131, an interface device 132, a storage device 140, and a processing circuit 150.

The motor 131 includes one or a plurality of motors. The motor 131 feeds and conveys a medium by rotating the pick roller 112, the feed roller 114, the separation roller 115, and the first to fifth conveyance rollers 117*a* to *e* in accordance with control pulses from the processing circuit 150. The first to fifth driven rollers 118*a* to *e* may be rotated by the motor 131 instead of being driven according to rotation of each conveyance roller.

The interface device 132 includes an interface circuit conforming to a serial bus such as USB. The interface device 132 is electrically connected to an unillustrated information processing device (such as a personal computer or a mobile information terminal) and transmits and receives various types of information including an input image. The medium conveying apparatus 100 may include a communication unit including an antenna transmitting and receiving wireless signals and a communication interface circuit for transmitting and receiving signals through a wireless communication line in locate of the interface device 132. For example, a communication protocol used by the communication interface circuit is a wireless local area network (LAN).

The storage device 140 includes a memory such as a random-access memory (RAM) or a read-only memory (ROM), a fixed disk device such as a hard disk, or a portable storage device such as a flexible disk or an optical disk. The storage device 140 stores a computer program, a database, a table, and the like that are used for various types of processing in the medium conveying apparatus 100. The computer program may be installed on the storage device 140 from a computer-readable and non-transitory portable storage medium by use of a known setup program or the like. Examples of the portable storage medium include a compact disc read-only memory (CD-ROM) and a digital versatile disc read-only memory (DVD-ROM).

The processing circuit 150 operates in accordance with a program previously stored in the storage device 140. For example, the processing circuit 150 is a central processing unit (CPU). Examples of the processing circuit 150 may also include a digital signal processor (DSP), a large-scale integration (LSI), an application specific integrated circuit (ASIC), and a field-programmable gate array (FPGA).

The processing circuit 150 is connected to the operation device 105, the display device 106, the first medium sensor 110, the lift sensor 112, the second medium sensor 115, the tilt sensor 116, the imaging device 119, the motor 131, the interface device 132, the storage device 140, and the like and controls these components. The processing circuit 150 conveys a medium by controlling the motor 131, acquires an input image by controlling the imaging device 119, and transmits the acquired input image to the information processing device through the interface device 132. Further, the processing circuit 150 determines whether a conveyed medium is a bound medium, based on a lift detection signal received from the lift sensor 112, a second medium signal received from the second medium sensor 115, and a signal received from the tilt sensor 116.

Figure 6:
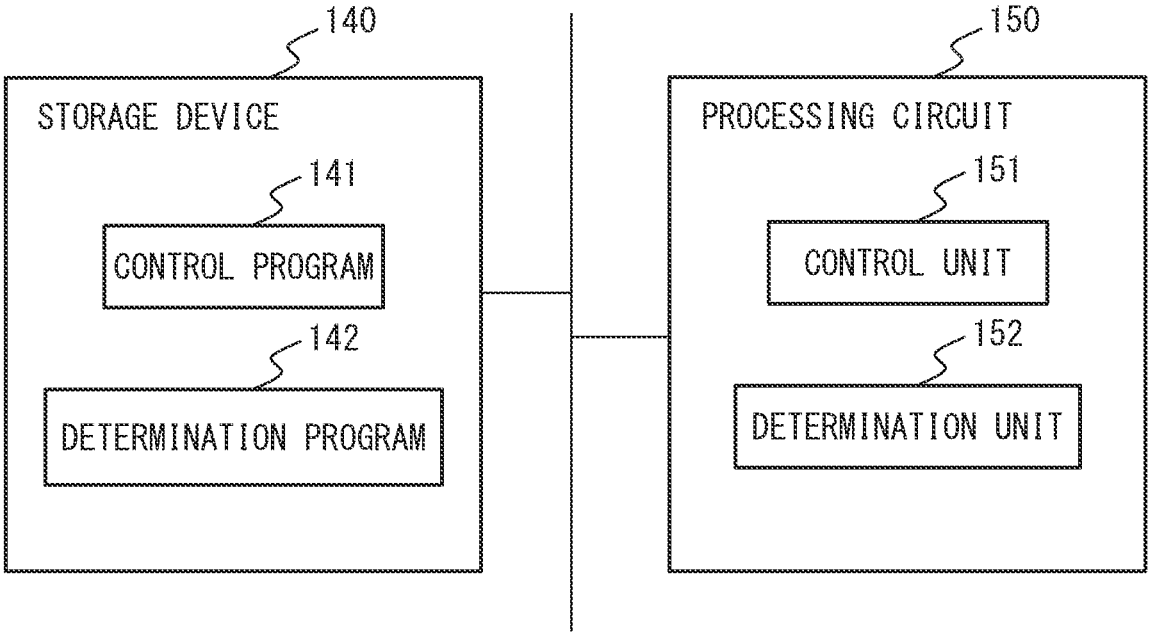
FIG. 6 is a functional block diagram of a storage device 140 and a processing circuit 150.

FIG. 6 is a diagram illustrating schematic configurations of the storage device 140 and the processing circuit 150.

Programs such as a control program 141 and a determination program 142 are stored in the storage device 140. Each program is a functional module implemented by software operating on a processor. The processing circuit 150 functions as a control unit 151 and a determination unit 152 by reading each program stored in the storage device 140 and operating in accordance with the read program.

Figure 7:
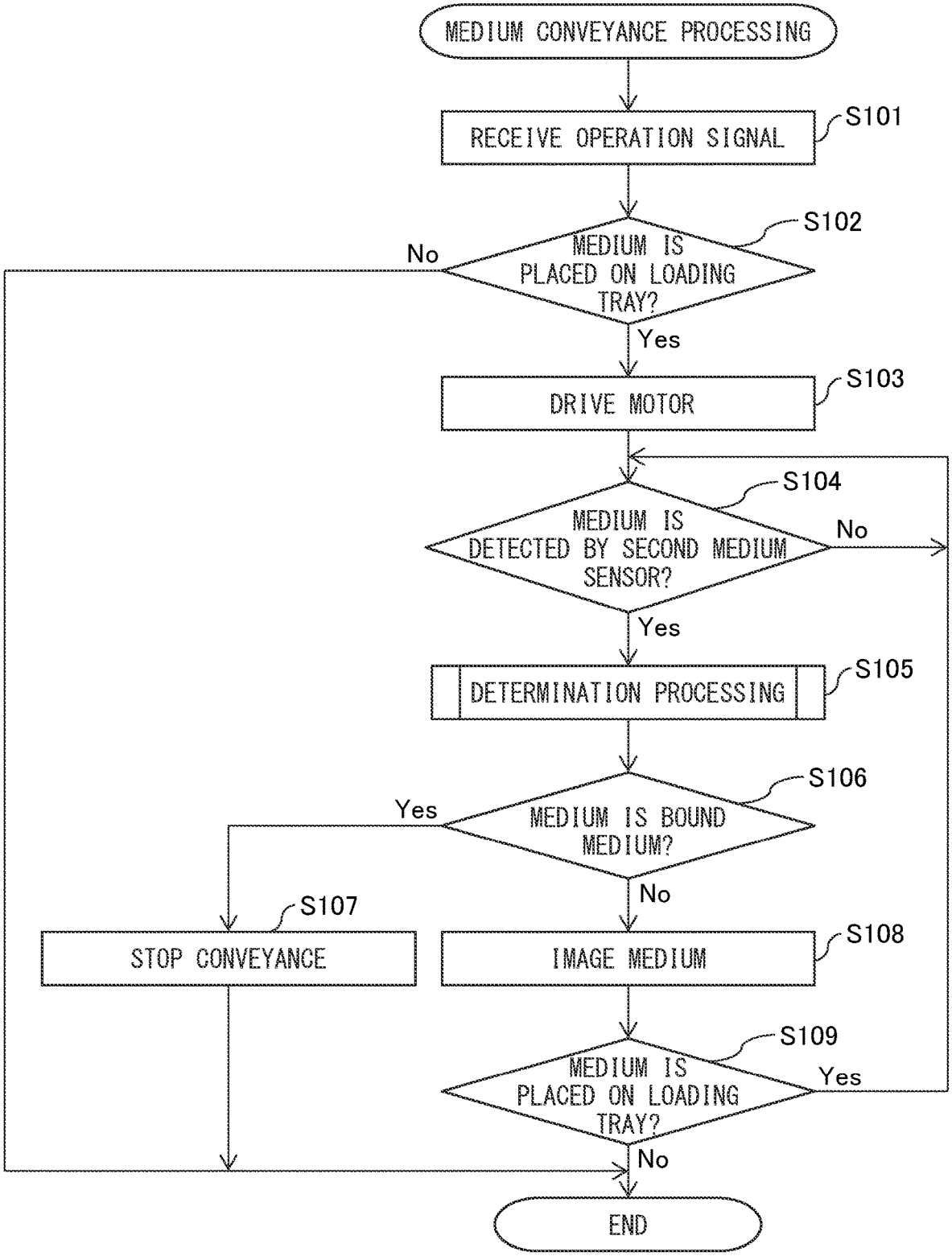
FIG. 7 is a flowchart illustrating a flow of medium conveyance processing.

FIG. 7 is a flowchart illustrating a flow of operation of medium conveyance processing executed by the medium conveying apparatus 100. The medium conveyance processing is achieved by cooperation between the processing circuit 150 and the components in the medium conveying apparatus 100 in accordance with a program stored in the storage device 140.

First, the control unit 151 stands by until an operation signal providing an instruction to read a medium is received (S101). The operation signal is fed to the control unit 151 from the operation device 105 in response to input of a read instruction of a medium to the operation device 105 by a user. The operation signal may be fed from the information processing device through the interface device 132 in response to input of a read instruction to the information processing device by the user.

Next, the control unit 151 determines whether a medium is placed on the loading tray 103, based on a first medium signal output from the first medium sensor 110 (S102). When a medium is not placed (S102: No), the medium image processing ends.

When a medium is placed (S102: Yes), the control unit 151 raises the loading tray 103 to a position allowing feed of the medium by driving a motor for moving the loading tray 103. The control unit 151 feeds and conveys the medium placed on the loading tray 103 by rotating the pick roller 111, the feed roller 113, the separation roller 114, and the first to fifth conveyance rollers 117*a* to *e* by driving the motor 131 (S103).

Next, the control unit 151 determines whether the medium is detected by the second medium sensor 115, based on a second medium signal output from the second medium sensor 115 (S104). When the second medium signal changes from a state indicating that light projected from the light-emitting element is not blocked by the medium to a state indicating that the light is blocked by the medium, the control unit 151 determines that the front edge of the medium has arrived at the position of the second medium sensor 115 and that the medium is detected by the second medium sensor 115. When the medium is not detected by the second medium sensor 115 (S104: No), the medium conveyance processing returns to S104 and the control unit 151 stands by until the medium is detected by the second medium sensor 115.

When the medium is detected by the second medium sensor 115 (S104: Yes), the determination unit 152 executes determination processing of determining whether the medium is a bound medium (S105). Details of the determination processing will be described later.

Next, the control unit 151 acquires the result of the determination processing from the determination unit 152 and determines whether the medium is a bound medium (S106). When the medium is a bound medium (S106: Yes), the control unit 151 stops conveyance of the medium by stopping the motor 131 (S107). Further, the control unit 151 causes the display device 106 to display a screen indicating existence of abnormality in conveyance of the medium. The above concludes the medium conveyance processing. Stopping of conveyance of a medium and display of a screen indicating existence of abnormality in conveyance of the medium on the display device 106 are examples of execution of abnormality control.

When the medium is not a bound medium (S106: No), the control unit 151 images the medium (S108). The control unit 151 stands by until the front edge of the medium arrives at an imaging start position between the second medium sensor 115 and the imaging device 119. For example, the control unit 151 determines that the front edge of the medium has arrived at the imaging start position when the front edge of the medium is conveyed by a predetermined distance after arriving at the position of the second medium sensor 115. When the front edge of the medium arrives at the imaging start position, the control unit 151 generates input images by sequentially imaging the medium with conveyance of the medium by controlling the imaging device 119. The control unit 151 transmits the generated input images to the information processing device through the interface device 132.

Next, the control unit 151 determines whether a medium is placed on the loading tray 103, based on the first medium signal output from the first medium sensor 110 (S109). When a medium is placed (S109: Yes), the medium conveyance processing returns to S104, and the control unit 151 stands by until a next medium is detected by the second medium sensor 115. When a medium is not placed (S109: No), the control unit 151 stops the motor 131. The above concludes the medium conveyance processing.

Figure 8:
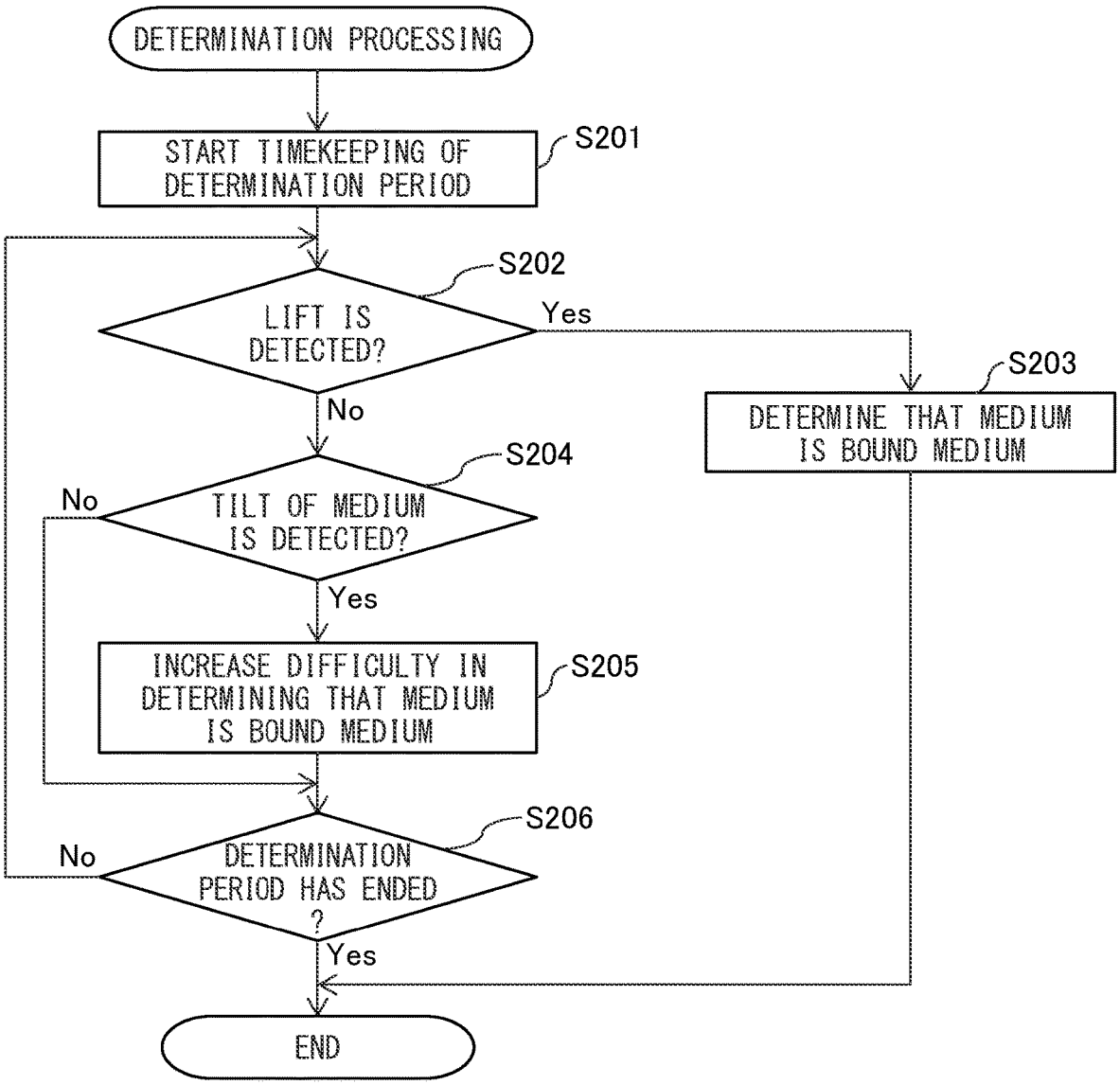
FIG. 8 is a flowchart illustrating a flow of determination processing.

FIG. 8 is a flowchart illustrating a flow of the determination processing executed by the medium conveying apparatus 100 in S105 in the medium conveyance processing. In the determination processing, whether a medium is a bound medium is determined.

First, the determination unit 152 starts timekeeping of a determination period (S201). The determination period is a period from arrival of a medium at the second medium sensor 115 until the medium is conveyed by a predetermined distance. In this case, the determination unit 152 starts counting of control pulses fed to the motor 131 driving the first to fifth conveyance rollers 117*a* to *e*. The determination period may be a period from arrival of a medium at the second medium sensor 115 until a predetermined amount of time elapses. In this case, the determination unit 152 starts measurement of the amount of time elapsed from the time of arrival of the medium at the second medium sensor 115. For example, the determination period is set to a period until the rear edge of a standard-sized medium (such as an A4 size) passes the feed roller 113 and the separation roller 114.

Next, the determination unit 152 determines whether a lift of the medium is detected by the lift sensor 112, based on a lift signal output by the lift sensor 112 (S202). When the intensity of light detected by the light-receiving element 112*f*, the intensity being indicated by the lift signal, is greater than or equal to the threshold value, the determination unit 152 determines that a lift of a medium is detected.

When a lift of the medium is detected by the lift sensor 112 (S202: Yes), the determination unit 152 determines that the medium is a bound medium (S203). The above concludes the determination processing.

When a lift of the medium is not detected by the lift sensor 112 (S202: No), the determination unit 152 determines whether a tilt of the medium is detected by the tilt sensor 116 (S204). When the first detection sensor 116-1 side of the medium precedes the second detection sensor 116-2 side or the second detection sensor 116-2 side of the medium precedes the first detection sensor 116-1 side, the determination unit 152 determines that a tilt of the medium is detected.

For example, in a case of the front edge of the medium being detected by the first detection sensor 116-1 and the front edge of the medium not being detected by the second detection sensor 116-2 when a predetermined amount of time elapses from the time at which the first detection sensor 116-1 detects the front edge of the medium, the determination unit 152 determines that the first detection sensor 116-1 side of the medium precedes the second detection sensor 116-2 side. In a case of the front edge of the medium being detected by the second detection sensor 116-2 and the front edge of the medium not being detected by the first detection sensor 116-1 when the predetermined amount of time elapses from the time at which the second detection sensor 116-2 detects the front edge of the medium, the determination unit 152 determines that the second detection sensor 116-2 side of the medium precedes the first detection sensor 116-1 side.

When the front edge of the medium is detected by neither the first detection sensor 116-1 nor the second detection sensor 116-2, the determination unit 152 determines that a tilt of the medium is not detected. The determination unit 152 also determines that a tilt of the medium is not detected when the front edge of the medium is detected only by one of the first detection sensor 116-1 and the second detection sensor 116-2 but the predetermined amount of time has not elapsed from the detection of the medium. The determination unit 152 also determines that a tilt of the medium is not detected when the medium is detected by one of the first detection sensor 116-1 and the second detection sensor 116-2 before the predetermined amount of time elapses from the time at which the medium is detected by the other.

The predetermined amount of time is set based on an allowable tilt of a medium. Since detection of a tilt of a medium is for detecting whether the rear edge of the medium runs on the side guide 103*a*, as will be described later, the allowable tilt is set, for example, within a range in which the rear edge of the medium does not come in contact with the side guide 103*a* in a state of the front edge of the medium being placed at the center in the width direction A4. The predetermined amount of time is set to, when a medium with the maximum allowable tilt is conveyed, the time difference between the time at which the first detection sensor 116-1 detects the front edge of the medium and the time at which the second detection sensor 116-2 detects the front edge of the medium.

When a tilt of the medium is detected (S204: Yes), the determination unit 152 increases difficulty in determining that the medium is a bound medium, based on the detection result of a lift of the medium by a lift sensor 112 on the preceding side of the medium out of the first lift sensor 112-1 and the second lift sensor 112-2 (S205). In other words, when it is detected that the first detection sensor 116-1 side of the medium precedes the second detection sensor 116-2 side, the determination unit 152 makes it difficult for the medium to be determined as a bound medium based on the detection result by the first lift sensor 112-1. When it is detected that the second detection sensor 116-2 side of the medium precedes the first detection sensor 116-1 side, the determination unit 152 makes it difficult for the medium to be determined as a bound medium, based on the detection result by the second lift sensor 112-2.

For example, making it difficult for the medium to be determined as a bound medium based on a detection result of a lift of the medium by a lift sensor 112 on the preceding side of the medium refers to not using the detection result by the lift sensor 112 on the preceding side in determination of whether the medium is a bound medium. For example, in a case of the first detection sensor 116-1 side of the medium preceding, the determination unit 152 determines that the medium is a bound medium when the second lift sensor 112-2 detects a lift of the medium in S202 but does not determine that the medium is a bound medium when only the first lift sensor 112-1 detects a lift of the medium. Similarly, in a case of the second detection sensor 116-2 side of the medium preceding, the determination unit 152 determines that the medium is a bound medium when the first lift sensor 112-1 detects a lift of the medium in S202 but does not determine that the medium is a bound medium when only the second lift sensor 112-2 detects a lift of the medium.

When a tilt of the medium is not detected (S204: No), the determination processing advances to S206.

Next, the determination unit 152 determines whether the determination period has ended (S206). For example, the determination unit 152 determines whether the determination period has ended, based on the number of control pulses fed to the motor 131 after the medium is detected by the second medium sensor 115.

When the determination period has not ended (S206: No), the determination processing returns to S202.

When the determination period has ended (S206: Yes), the determination processing ends.

A principle of determination in the determination processing will be described below.

Figure 9A:
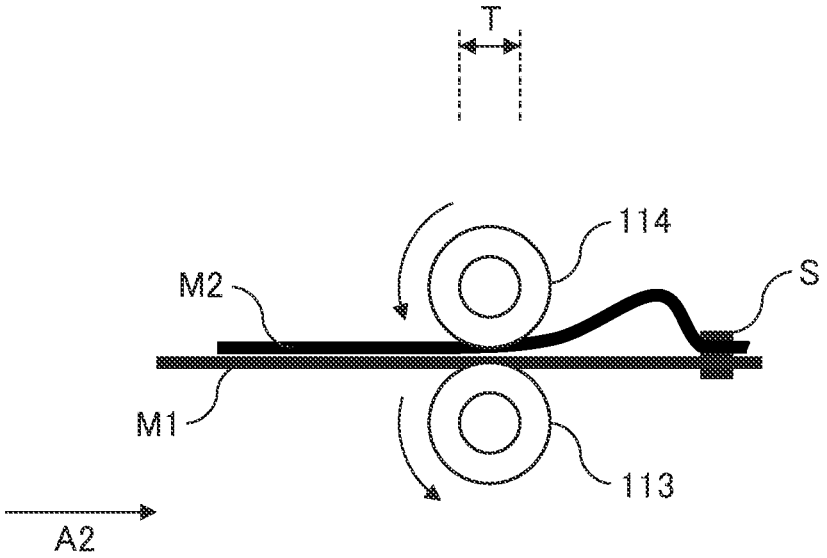
FIG. 9A is a schematic side view of a bound medium.

FIG. 9A is a schematic side view of a bound medium arriving at the position of the feed roller 113 and the separation roller 114. In the example illustrated in FIG. 9A, the bound medium is a medium acquired by binding a lower-side medium M1 and an upper-side medium M2 by a binding part S. When the bound medium arrives at the position of the feed roller 113 and the separation roller 114, the lower-side medium M1 stops by rotation of the separation roller 114, and only the upper-side medium M2 attempts to progress in the conveying direction A2 by rotation of the feed roller 113. At this time, since the front edge of the upper-side medium M2 is fixed to the lower-side medium M1 by the binding part S, a lift occurs between a region T of the upper-side medium M2 being in contact with the feed roller 113 and the binding part S. Accordingly, whether a medium is a bound medium can be determined based on whether a lift of the medium is detected by the lift sensor 112.

Figure 9B:
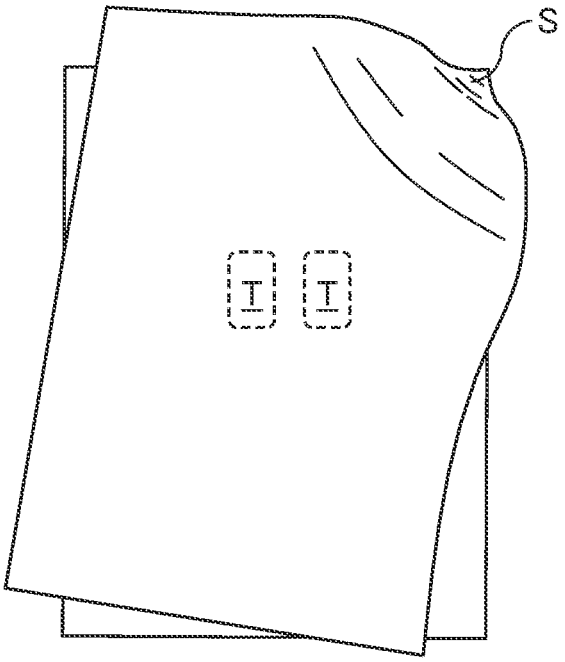
FIG. 9B is a schematic plan view of the bound medium.

FIG. 9B is a schematic plan view of the bound medium arriving at the position of the feed roller 113 and the separation roller 114. As illustrated in FIG. 9B, while the upper-side medium M2 attempts to progress in the conveying direction A2 by rotation of the feed roller 113, one side of the front edge is bound by the binding part S, and therefore, the upper-side medium M2 tilts in such a way that the side opposite to the binding part S side precedes in the conveying direction A2. In other words, when a bound medium is conveyed, one side of the front edge of the medium precedes toward the conveying direction A2, and a lift occurs on the other side.

Figure 10A:
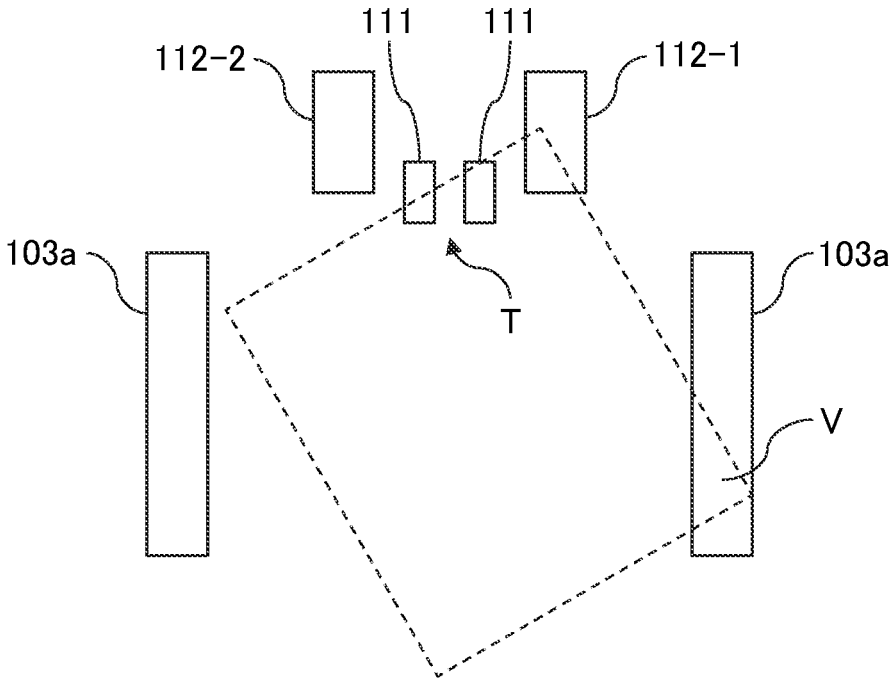
FIG. 10A is a schematic plan view of a medium conveyed in a tilted manner.
Figure 10B:
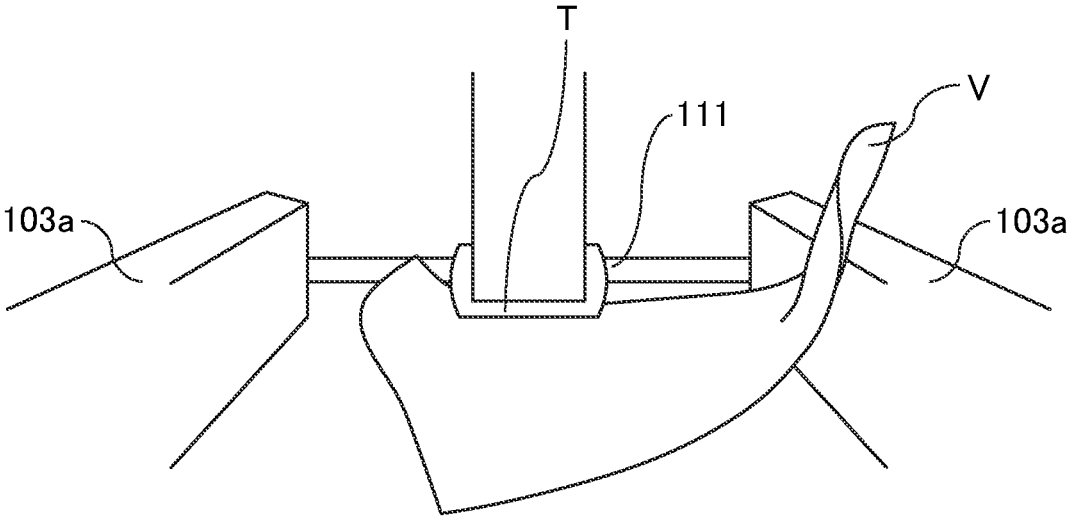
FIG. 10B is a schematic view of the medium conveyed in a tilted manner viewed toward a conveying direction A2.

FIG. 10A is a schematic plan view of a normal medium (referring to a medium not being a bound medium) conveyed in a tilted manner with respect to the conveying direction A2, and FIG. 10B is a schematic view of the normal medium conveyed in a tilted manner viewed toward the conveying direction A2. When a tilt of the medium is large, the rear edge of the medium may run on the side guide 103*a* of the loading tray 103 when the medium is fed. In this case, a lift occurs between a part V of the medium running on the side guide 103*a* and a region T being in contact with the pick roller 111. Accordingly, a lift of a medium is detected by the lift sensor 112 when a normal medium is conveyed in a tilted manner as well.

When the rear edge of a medium runs on the side guide 103*a*, the medium is tilted, and one side running on the side guide 103*a* precedes the other side toward the width direction A4. In the examples illustrated in FIG. 10A and FIG. 10B, the right side of the medium precedes the left side toward the conveying direction A2, and therefore, the right side of the rear edge runs on the side guide 103*a*. Accordingly, a lift of the medium occurs on the right side with respect to the pick roller 111. In other words, when a normal medium is conveyed in a tilted manner, one side of the front edge of the medium precedes in the conveying direction A2, and a lift occurs on the one side.

Accordingly, by increasing, by the determination unit 152, difficulty in determining that a medium is a bound medium, based on a detection result of a lift of the medium by the lift sensor 112 on the preceding side of the medium, erroneous detection of a medium conveyed in a tilted manner as a bound medium is prevented.

As described above, when one side of a medium precedes the other side in the conveying direction A2, the medium conveying apparatus 100 increases difficulty in determining that a medium is a bound medium, based on a detection result of a lift of the medium by the lift sensor 112 on the one side. Consequently, the medium conveying apparatus 100 enables distinction between a bound medium and a normal medium conveyed in a tilted manner and more precise determination of whether a medium is a medium on which abnormality control is to be executed.

While the determination unit 152 does not use a detection result by a lift sensor 112 on the preceding side of a medium in determination of a bound medium in S205 in the determination processing in the aforementioned description, the processing is not limited to such an example. The determination unit 152 may shorten the determination period for a lift sensor 112 on the preceding side.

In this case, the determination unit 152 starts timekeeping of the determination period for each of the first lift sensor 112-1 and the second lift sensor 112-2 in S201 in the determination processing. In S205, the determination unit 152 shortens the determination period for a lift sensor 112 on the preceding side by a predetermined amount of time. Further, in S206, the determination unit 152 determines whether the determination period has ended for each of the first lift sensor 112-1 and the second lift sensor 112-2. When the determination period for only one of the first lift sensor 112-1 and second lift sensor 112-2 has ended, the determination unit 152 does not use a detection result by the lift sensor 112 the determination period of which has ended in determination of a bound medium from then onward, and the determination processing returns to S202. When the determination periods of both the first lift sensor 112-1 and the second lift sensor 112-2 have ended, the determination processing ends. By suitably setting the determination period after the change, the medium conveying apparatus 100 enables precise distinction between a bound medium and a medium conveyed in a tilted manner and more precise determination of whether a medium is a medium on which abnormality control is to be executed.

While the lift sensor 112 includes the arm 112*a* and the horseshoe-shaped sensor 112*b* in the aforementioned description, the sensor is not limited to such an example. The lift sensor 112 may be an optical range sensor including a light-emitting element, such as an LED, placed above the conveyance path of a medium and a light-receiving element, such as a photodiode, detecting light being projected from the LED and being reflected by a medium. In this case, the lift sensor 112 outputs, as a lift signal, a signal indicating a value varying by the time between projection of light by the light-emitting element and reception of the light by the light-receiving element. For example, the lift sensor 112 detects a lift of a medium when the time between projection of light by the light-emitting element and reception of the light by the photodiode, the time being indicated by the lift signal, is less than or equal to a threshold value.

In this case, further in S205 in the determination processing, the determination unit 152 may make it difficult for the medium to be determined as a bound medium based on a detection result of a lift of the medium by a lift sensor 112 on the preceding side of the medium, by decreasing the threshold value for a lift sensor 112 on the preceding side of a medium. For example, when the first detection sensor 116-1 side of a medium precedes, the determination unit 152 decreases the threshold value for the first lift sensor 112-1. When the second detection sensor 116-2 side of a medium precedes, the determination unit 152 decreases the threshold value for the second lift sensor 112-2. By suitably setting the threshold value after the change, the medium conveying apparatus 100 enables precise distinction between a bound medium and a tilted medium and more precise determination of whether a medium is a medium on which abnormality control is to be executed.

Figure 11:
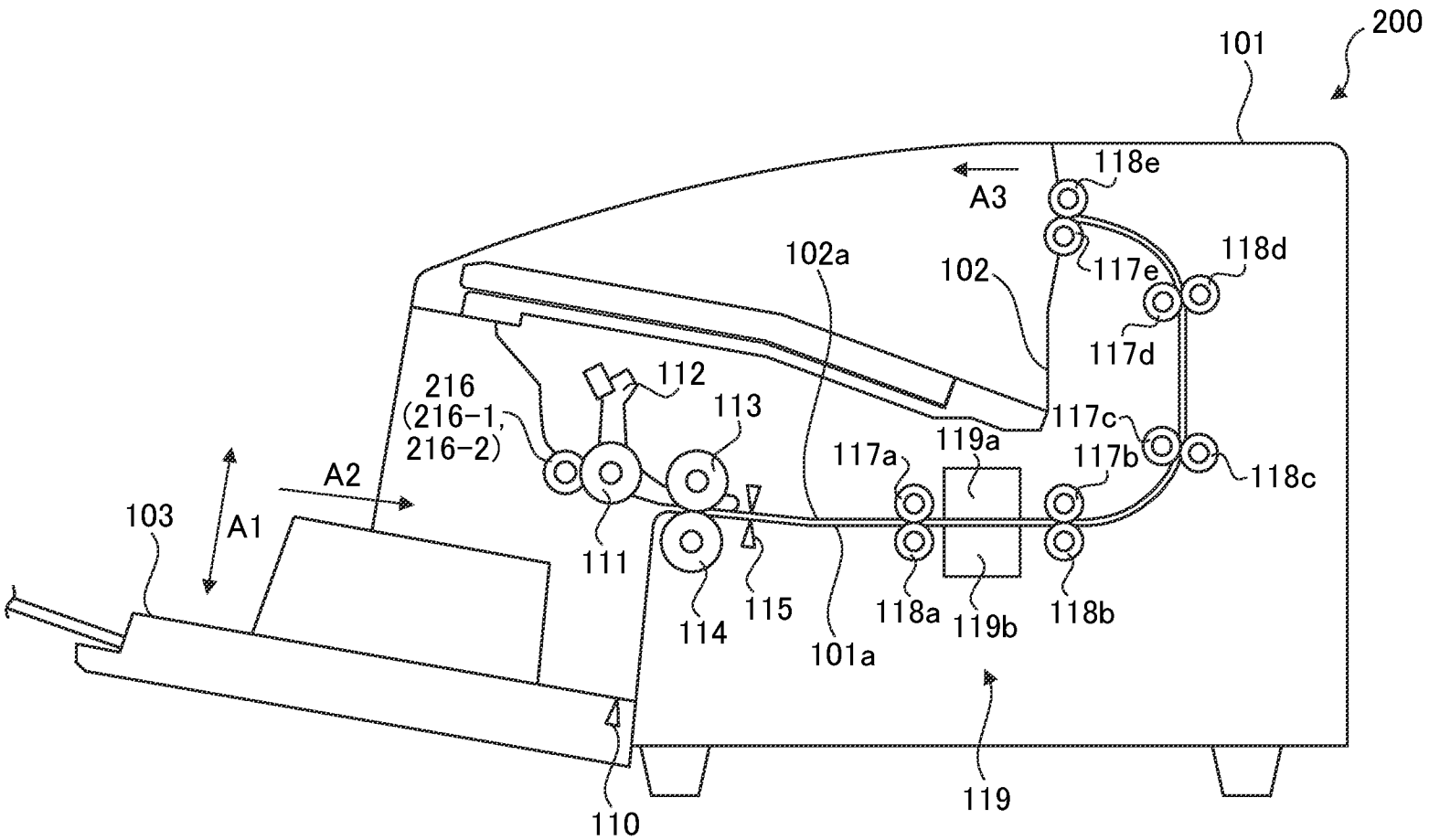
FIG. 11 is a diagram illustrating a conveyance path inside a medium conveying apparatus 200.

FIG. 11 is a diagram illustrating a conveyance path in a medium conveying apparatus 200 according to another embodiment. The medium conveying apparatus 200 differs from the medium conveying apparatus 100 in including a tilt sensor 216 in place of the tilt sensor 116.

The tilt sensor 216 is located on the upstream side of a pick roller 111. The tilt sensor 216 detects a tilt of a medium. The tilt sensor 216 includes a first speed sensor 216-1 and a second speed sensor 216-2 being located in a width direction A4 and spaced from each other, each sensor detecting the speed of a medium.

For example, the first speed sensor 216-1 is a slit-type encoder. The first speed sensor 216-1 includes a rotating member being provided with a slit and rotating with passing of a medium, a light-emitting element such as an LED, and a light-receiving element such as a photodiode. Light pulses are generated by light emitted from the light-emitting element such as an LED passing through the rotating slit. The first speed sensor 216-1 generates and outputs, as a first speed signal, a signal based on the widths or the interval of light pulses detected by the light-receiving element, i.e., a signal based on the moving speed of the medium.

The second speed sensor 216-2 has a structure similar to that of the first speed sensor 216-1. The second speed sensor 216-2 generates and outputs, as a second speed signal, a signal based on the widths or the interval of light pulses detected by a light-receiving element, i.e., a signal based on the moving speed of a medium.

The tilt sensor 216 detects a tilt of a medium when the difference between the moving speed of the medium indicated by the first speed signal and the moving speed of the medium indicated by the second speed signal is greater than or equal to a threshold value.

Each of the first speed sensor 216-1 and the second speed sensor 216-2 may be a magnetic encoder detecting a change in magnetism caused by rotation of a rotating member equipped with a magnet.

Figure 12:
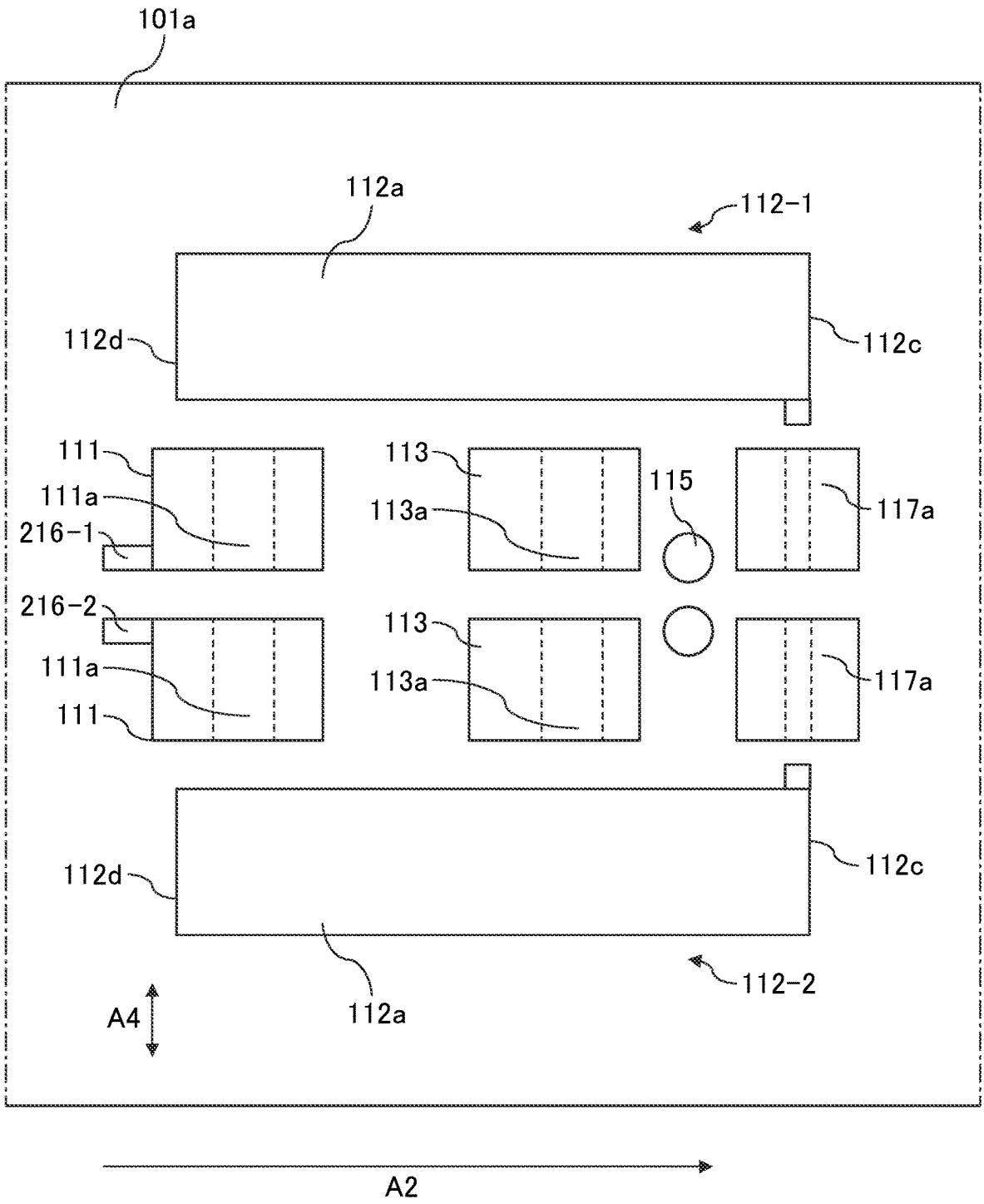
FIG. 12 is a diagram schematically illustrating placement of lift sensors 112, a second medium sensor 115, and tilt sensors 216.

FIG. 12 is a diagram schematically illustrating placement of lift sensors 112, a second medium sensor 115, and the tilt sensors 216. FIG. 12 is a diagram of the conveyance path viewed from the top.

An upstream edge 112*d* of an arm 112*a* of each of a first lift sensor 112-1 and a second lift sensor 112-2 is positioned on the upstream side of the upstream edge of a nip width 111*a* of the pick roller 111. A downstream edge 112*c* of the arm 112*a* of each of the first lift sensor 112-1 and the second lift sensor 112-2 is positioned on the downstream side of the upstream edge of a nip width of a first conveyance roller 117*a*. Consequently, the lift sensor 112 detects a lift of a medium between the upstream edge of the nip width 111*a* of the pick roller 111 and the upstream edge of the nip width of the first conveyance roller 117*a*.

The first speed sensor 216-1 and the second speed sensor 216-2 in the tilt sensor 216 are spaced on the upstream side of the pick roller 111 in the width direction A4. The first speed sensor 216-1 is placed on the left side of the pick roller 111 and a feed roller 113 toward a conveying direction A2, i.e., in the width direction A4. The second speed sensor 216-2 is placed on the right side of the pick roller 111 and the feed roller 113 toward the conveying direction A2, i.e., in the width direction A4. In other words, the first speed sensor 216-1 is placed on the same side as the first lift sensor 112-1 with respect to the pick roller 111, and the second speed sensor 216-2 is placed on the same side as the second lift sensor 112-2 with respect to the pick roller 111.

Figure 13:
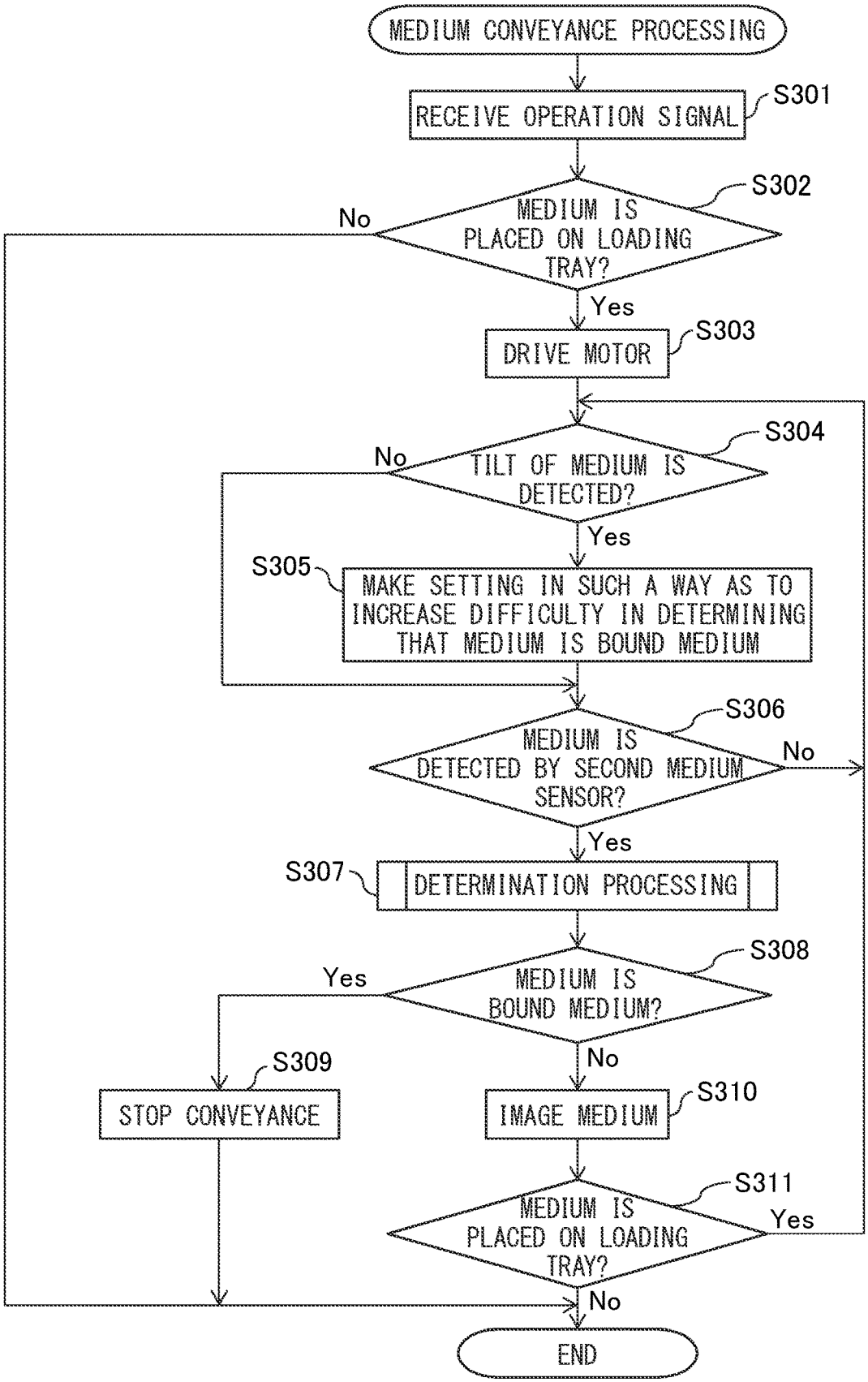
FIG. 13 is a flowchart illustrating a flow of medium conveyance processing.

FIG. 13 is a flowchart illustrating a flow of operation of medium conveyance processing executed by the medium conveying apparatus 200. The medium conveyance processing is achieved by cooperation between a processing circuit 150 and components in the medium conveying apparatus 200 in accordance with a program stored in a storage device 140. Processing in S301 to S303 and S307 to S311 in FIG. 13 is similar to the processing in S101 to S103 and S105 to S109 in FIG. 7, and therefore, description thereof is omitted, and only S304 to S306 will be described below.

After a motor 131 is driven in S303, a determination unit 152 determines whether a tilt of a medium is detected by the tilt sensor 216 (S304). When the first speed sensor 216-1 side of the medium precedes the second speed sensor 216-2 side or when the second speed sensor 216-2 side of the medium precedes the first speed sensor 216-1 side, the determination unit 152 determines that a tilt of the medium is detected. For example, the determination unit 152 determines that a tilt of a medium is detected by the tilt sensor 216 when the difference between the moving speed of the medium indicated by the first speed signal and the moving speed of the medium indicated by the second speed signal is greater than or equal to the threshold value.

When a tilt of the medium is detected (S304: Yes), the determination unit 152 increases difficulty in determining that the medium is a bound medium, based on a detection result of a lift of the medium by a lift sensor 112 on the preceding side of the medium out of the first lift sensor 112-1 and the second lift sensor 112-2 (S305).

When a tilt of the medium is not detected (S304: No), the medium conveyance processing advances to S306.

Next, a control unit 151 determines whether the medium is detected by the second medium sensor 115, based on a second medium signal output from the second medium sensor 115 (S306). When the medium is not detected by the second medium sensor 115 (S306: No), the control unit 151 returns to S304 and stands by until a tilt of the medium is detected by the tilt sensor 216 or until the medium is detected by the second medium sensor 115.

Note that the processing in S204 to S205 is omitted in the determination processing executed by the medium conveying apparatus 200.

Thus, the medium conveying apparatus 200 detects a tilt of a medium by the tilt sensor 216 placed on the upstream side of the pick roller. Consequently, when a lift of a medium is detected by the lift sensor 112 before the medium is detected by the second medium sensor 115, the medium conveying apparatus 200 can stop conveyance at that point in time and enables prevention of damage to a bound medium.

Figure 14:
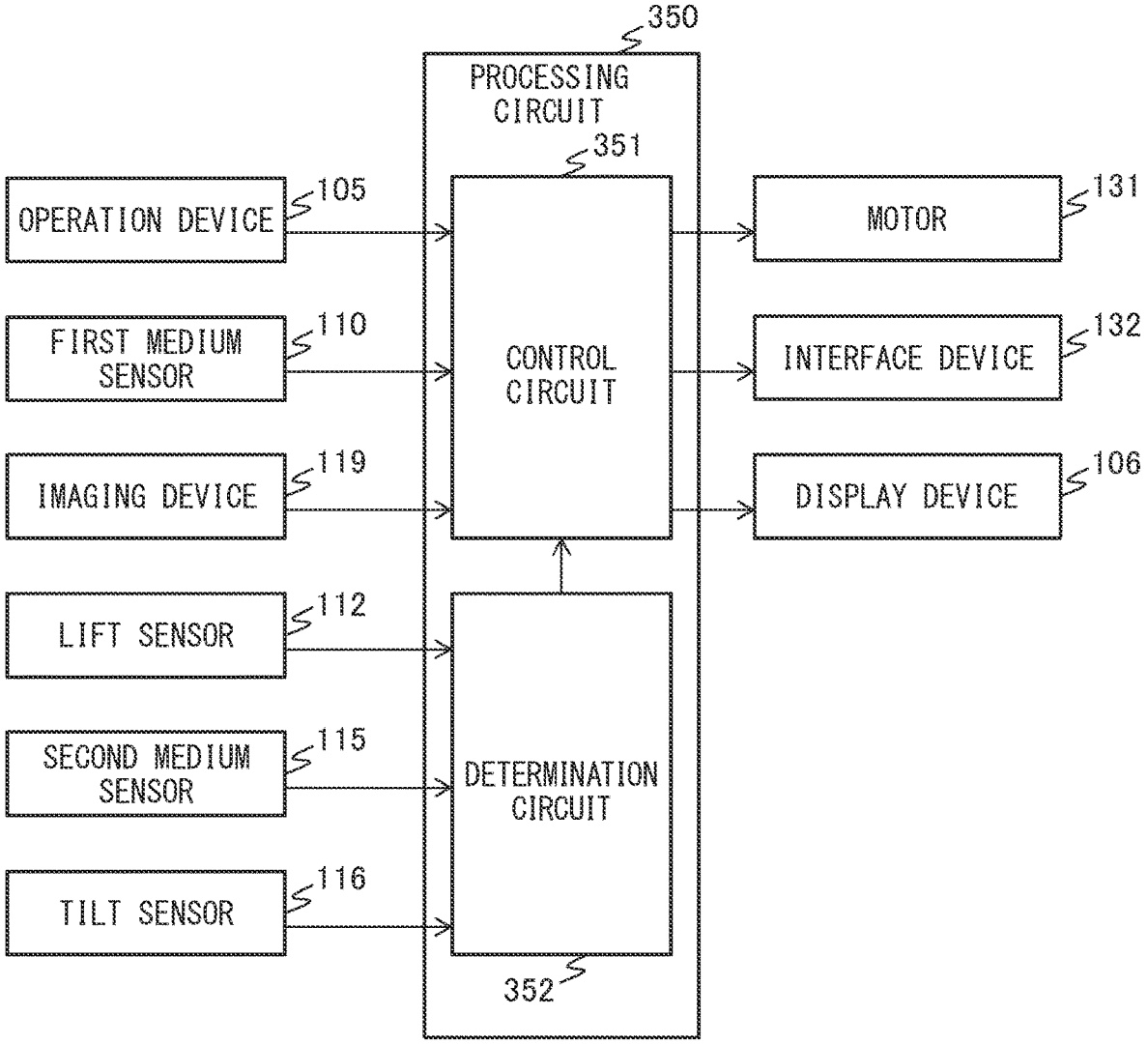
FIG. 14 is a functional block diagram of a processing circuit 350.

FIG. 14 is a diagram illustrating a schematic configuration of a processing circuit 350 included in a medium conveying apparatus according to another embodiment. The processing circuit 350 is used in place of the processing circuit 150 and executes the medium conveyance processing. The processing circuit 350 includes a control circuit 351, a determination circuit 352, and the like. Each of the components may be independently configured with an integrated circuit, a microprocessor, firmware, or the like.

The control circuit 351 is an example of a control unit and has a function similar to that of the control unit 151. The control circuit 351 receives an operation signal from an operation device 105, a first medium signal from a first medium sensor 110, and a determination result in the determination processing from the determination circuit 352 and controls a motor 131, based on the received signals and the received determination result. Further, the control circuit 351 receives an input image from an imaging device 119 and transmits the image to an information processing device through an interface device 132.

The determination circuit 352 is an example of a determination unit and has a function similar to that of the determination unit 152. The determination circuit 352 receives a lift detection signal, a second medium signal, and first and second detection signals from a lift sensor 112, a second medium sensor, 115 and a tilt sensor 116, respectively. The determination circuit 352 determines whether a medium is a bound medium, or the like, based on the received signals and outputs the determination result to the control circuit 351.

As described above, the medium conveying apparatus enables suitable detection of a bound medium when the processing circuit 350 is used as well.

The medium conveying apparatus, the control method, and the computer program enable more precise determination of whether a medium is a predetermined medium on which abnormality control is to be executed.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that various changes, substitutions, and alterations can be made hereto without departing from the spirit and scope of the invention.

The invention claimed is:

1. A medium conveying apparatus comprising:

a pick roller to feed a medium;

a first lift sensor located on a downstream side of an upstream edge of a nip width of the pick roller and on one side of the pick roller toward a conveying direction of the medium, to detect a lift of the medium;

a second lift sensor located on the downstream side of the upstream edge of the nip width of the pick roller and on another side of the pick roller toward the conveying direction, to detect a lift of the medium;

a first detection sensor located on a same side as the first lift sensor with respect to the pick roller, to detect the medium;

a second detection sensor located on a same side as the second lift sensor with respect to the pick roller, to detect the medium; and a processor to determine that the medium is a predetermined medium when a height of a lift of the medium detected by the first lift sensor or second lift sensor is greater than or equal to a threshold value; and execute abnormality control when the medium is determined to be the predetermined medium, wherein the processor increases the threshold value for the first lift sensor when it is detected by the first and second detection sensors that the first detection sensor side of the medium precedes the second detection side of the medium.

2. The medium conveying apparatus according to claim 1, further comprising a separation roller located on the downstream side of the pick roller in the conveying direction, wherein the first and second detection sensors are medium sensors placed on a downstream side of a downstream edge of a nip width of the separation roller and spaced from each other in a direction orthogonal to the conveying direction, each sensor detecting the medium at a position where the sensor is located.

3. The medium conveying apparatus according to claim 1, further comprising a separation roller located on a downstream side of the pick roller in the conveying direction, wherein the first and second detection sensors are speed sensors placed on an upstream side of an upstream edge of a nip width of the separation roller and spaced from each other in a direction orthogonal to the conveying direction, each sensor measuring speed of the medium.

4. The medium conveying apparatus according to claim 1, further comprising a separation roller located on a downstream side of the pick roller in the conveying direction, wherein the processor determines that the medium is the predetermined medium when the lift of the medium is detected by the first or second lift sensor in a determination period immediately after the medium passes the separation roller, and shortens the determination period for the first lift sensor when detecting that the first detection sensor side of the medium precedes the second detection sensor side.

5. A medium conveying method comprising:

feeding a medium by a pick roller;

detecting a lift of the medium by a first lift sensor located on a downstream side of an upstream edge of a nip width of the pick roller and on one side of the pick roller toward a conveying direction of the medium;

detecting a lift of the medium by a second lift sensor placed on the downstream side of the upstream edge of the nip width of the pick roller and on another side of the pick roller toward the conveying direction;

detecting the medium by a first detection sensor placed on a same side as the first lift sensor with respect to the pick roller;

detecting the medium by a second detection sensor placed on a same side as the second lift sensor with respect to the pick roller;

determining that the medium is a predetermined medium when a height of a lift of the medium detected by the first lift sensor or second lift sensor is greater than or equal to a threshold value; and executing abnormality control when the medium is determined to be the predetermined medium, wherein, in the determination, the threshold value for the first lift sensor is increased when it is detected by the first and second detection sensors that the first detection sensor side of the medium precedes the second detection sensor side.

6. The medium conveying method according to claim 5, wherein the first and second detection sensors are medium sensors placed on a downstream side of a downstream edge of a nip width of a separation roller and spaced from each other in a direction orthogonal to the conveying direction, the separation roller being located on a downstream side of the pick roller in the conveying direction, each sensor detecting the medium at a position where the sensor is located.

7. The medium conveying method according to claim 5, wherein the first and second detection sensors are speed sensors placed on an upstream side of an upstream edge of a nip width of a separation roller and spaced from each other in a direction orthogonal to the conveying direction, the separation roller being located on a downstream side of the pick roller in the conveying direction, each sensor detecting the medium at a position where the sensor is located each sensor measuring speed of the medium.

8. The medium conveying method according to claim 5, wherein the medium is determined to be the predetermined medium when the lift of the medium is detected by the first lift sensor or second lift sensor in a determination period immediately after the medium passes a separation roller, the separation roller being located on a downstream side of the pick roller in the conveying direction, and the determination period for the first lift sensor is shortened when the first detection sensor side of the medium is detected to precede the second detection sensor side.

9. A computer-readable, non-transitory storage medium storing a computer program for a medium conveying apparatus including a pick roller feeding a medium, a first lift sensor located on a downstream side of an upstream edge of a nip width of the pick roller and on one side of the pick roller toward a conveying direction of the medium, to detect a lift of the medium, a second lift sensor located on the downstream side of the upstream edge of the nip width of the pick roller and on another side of the pick roller toward the conveying direction, to detect a lift of the medium, a first detection sensor located on a same side as the first lift sensor with respect to the pick roller, to detect the medium; and a second detection sensor located on a same side as the second lift sensor with respect to the pick roller, to detect the medium, the computer program causing the medium conveying apparatus to execute a process, the process comprising:

determining that the medium is a predetermined medium when a height of a lift of the medium detected by the first lift sensor or second lift sensor is greater than or equal to a threshold value; and executing abnormality control when the medium is determined to be the predetermined medium, wherein, in the determination, the threshold value for the first lift sensor is increased when it is detected by the first and second detection sensors that the first detection sensor side of the medium precedes the second detection sensor side.

10. The storage medium according to claim 9, wherein the medium conveying apparatus further includes a separation roller located on a downstream side of the pick roller in the conveying direction, and the first and second detection sensors are medium sensors placed on a downstream side of a downstream edge of a nip width of the separation roller and spaced from each other in a direction orthogonal to the conveying direction, each sensor detecting the medium at a position where the sensor is located.

11. The storage medium according to claim 9, wherein the medium conveying apparatus further includes a separation roller located on a downstream side of the pick roller in the conveying direction, and the first and second detection sensors are speed sensors placed on an upstream side of an upstream edge of a nip width of the separation roller and spaced from each other in a direction orthogonal to the conveying direction, each sensor measuring speed of the medium.

12. The storage medium according to claim 9, wherein the medium conveying apparatus further includes a separation roller located on a downstream side of the pick roller in the conveying direction, the medium is determined to be the predetermined medium when the lift of the medium is detected by the first lift sensor or second lift sensor in a determination period immediately after the medium passes the separation roller, and the determination period for the first lift sensor is shortened when the first detection sensor side of the medium is detected to precede the second detection sensor side.

* * * * *